US007437985B2

(12) United States Patent
Gal

(10) Patent No.: US 7,437,985 B2
(45) Date of Patent: Oct. 21, 2008

(54) WEAPON LAUNCHED RECONNAISSANCE SYSTEM

(75) Inventor: Ehud Gal, Reut (IL)

(73) Assignee: O.D.F. Electronics Ltd., Tel Aviv (IL)

( * ) Notice: Subject to any disclaimer, the term of this patent is extended or adjusted under 35 U.S.C. 154(b) by 0 days.

(21) Appl. No.: 11/791,625

(22) PCT Filed: Nov. 30, 2005

(86) PCT No.: PCT/IL2005/001278

§ 371 (c)(1),
(2), (4) Date: Aug. 20, 2007

(87) PCT Pub. No.: WO2006/059326

PCT Pub. Date: Jun. 8, 2006

(65) Prior Publication Data

US 2008/0115687 A1 May 22, 2008

(30) Foreign Application Priority Data

Dec. 1, 2004 (IL) ..... 165489

(51) Int. Cl.
*B64D 1/04* (2006.01)

(52) U.S. Cl. ..... 89/1.11; 102/502; 340/901

(58) Field of Classification Search ..... 102/501, 102/502; 89/1.1, 1.11; 244/3.1, 3.16; 340/901, 340/904

See application file for complete search history.

(56) References Cited

U.S. PATENT DOCUMENTS

| | | | | |
|---|---|---|---|---|
| 4,964,591 | A * | 10/1990 | Wilmot et al. | 244/3.16 |
| 6,978,717 | B1 * | 12/2005 | Hambric | 102/473 |
| 2004/0075585 | A1 * | 4/2004 | Kaiser et al. | 340/946 |
| 2005/0152087 | A2 * | 7/2005 | Smith et al. | 361/232 |
| 2006/0005733 | A1 * | 1/2006 | Rastegar et al. | 102/513 |
| 2006/0283345 | A1 * | 12/2006 | Feldman et al. | 102/430 |

* cited by examiner

*Primary Examiner*—John W Eldred
(74) *Attorney, Agent, or Firm*—Frommer Lawrence & Haug LLP; William S. Frommer; Thomas F. Presson

(57) ABSTRACT

The present invention is an arrow-shaped reconnaissance means, which is designed to be connected to the barrel of a weapon and launched by firing a round of ammunition from the weapon. The reconnaissance means is designed to penetrate and stick into a wall or other target and transmit video and additional data from its location, providing information gathered from an elevated position about the area around the target.

19 Claims, 2 Drawing Sheets

WEAPON LAUNCHED RECONNAISSANCE SYSTEM

FIELD OF THE INVENTION

The present invention relates to the field of imaging. More specifically the invention relates to a reconnaissance system designed to be shot by a rifle towards a target, stick into the target and transmit imagery and other data from the target area.

BACKGROUND OF THE INVENTION

Military and law enforcement operations in urban areas require combat units to obtain maximum information about the battle zone in order to enable correct planning of the combat operation as well as to provide constant awareness of potential threats during the operation.

When combat units operate in an urban area they are often exposed to very diversified threats, which include: enemy fire in open areas, sniper fire from surrounding buildings, a variety of explosive devices including land mines and improvised explosive devices, close-quarter combat, and more.

In today's battlefield, which is mostly located around civilian population concentrations, it is of great benefit to be able to locate the civilian population to avoid unintended "collateral damage" as well as to assess whether the civilian population is hostile and constitutes a potential threat to the combat unit.

Movement in streets and alleys is considered to have great potential danger since it is difficult to be sure of the nature of threats waiting around each corner. The assessment of such threats is especially important to infantry troops, which are the most vulnerable to most of the threats.

Special operations, which usually involve clearing buildings or rescuing hostages, are also characterized by great danger and require the combat unit to have good understanding of the nature and position of hostile elements inside the building. Better understanding of the layout of hostile elements inside the building can help in proper planning of the storming approach and may save lives of the combatants as well as the hostages.

At the same time that combat units are exposed to enemy threats, they sometime become a victim of "friendly fire" when combat units of the same side mistakenly take each other as the enemy and engage in combat.

Due to the large number and nature of threats on combat units operating in urban areas, it is of great benefit to provide combat units with the ability to obtain real-time reconnaissance of the combat zone, preferably from an elevated position, so that the combat unit will have an awareness of the entire combat zone, with the ability to detect threats from various locations and assess the potential of unseen threats when planning the unit's movements.

The prior art has provided several reconnaissance means which provide reconnaissance from an elevated position. The use of UAVs (Unmanned Aerial Vehicles) is widespread and is used to provide both real-time reconnaissance to the field-level unit as well as reconnaissance for intelligence purposes transmitted to remote command stations. UAVs can be operated either directly by the combat unit or may be launched from a remote location by air force or intelligence operators. The main disadvantages in operating UAVs are:

- the need for skilled operators to launch and control the vehicle;
- power sources that support operation of the vehicle as well as its payload;

- potential loss of the UAV which, if it crashes in enemy territory, may result in exposure of sensitive technology; and
- high procurement and maintenance costs.

Another reconnaissance means presented by the prior art is a reconnaissance projectile developed by Israeli defense contractors. The projectile is designed to be launched from a mortar and provides reconnaissance during its several seconds of flight. This projectile provides visual information for a very limited period of time, which is not necessarily sufficient for an understanding of the events being observed. Once the projectile lands it is unrecoverable. In order to obtain more visual information it is necessary to launch additional projectiles.

The prior art does not provide a disposable reconnaissance means which can be used at all field levels, with quick operation and with no maintenance need or special training of the operator. Furthermore, the prior art does not present reconnaissance means other than UAVs or satellites which can transmit visual and additional information from an elevated position for significant periods of time.

It is a purpose of the present invention to provide reconnaissance means in the form of an arrow that is designed to be shot from a rifle.

It is another purpose of the present invention to provide reconnaissance means in the form of an arrow that is designed to stick into a wall after being shot, and to transmit data from its location by means of wireless communications.

Additional purposes of the invention will become apparent as the description proceeds.

SUMMARY OF THE INVENTION

The present invention is an arrow-shaped reconnaissance means, which is designed to be connected to the barrel of a rifle and shot from the rifle. The arrow is designed to stick into a wall and transmit video and additional data from its location, providing reconnaissance from an elevated position. As opposed to prior art means described hereinabove, the system of the present invention provides reconnaissance from a stationary position and not during flight.

In a first aspect the invention is a weapon launched reconnaissance system comprising: a rear assembly connectable to the barrel of a weapon, a center assembly, connected to the front end of the rear assembly, a sensor assembly, and a front assembly, connected to the front end of the center assembly.

The rear assembly has a hollow passage that enables a bullet and/or exhaust gases coming out of the barrel to pass through it when the weapon is fired. The rear assembly preferably comprises fins on its exterior surface. The center assembly comprises components for absorbing the momentum of the bullet and/or gases and transferring the momentum to the reconnaissance system. In some embodiments the center assembly comprises slots or other mechanisms on its perimeter to release gas and pressure. The sensor assembly includes one or more sensors and data transmission components. In different embodiments the sensor assembly is located exterior to the center assembly or it is located inside the center assembly, in a portion of the center assembly which does not absorb the direct impact of the bullet or the gases. The front assembly comprises a nose portion capable of penetrating and sticking to solid materials upon impact.

When the reconnaissance system is connected to the end of the barrel of the weapon by means of the rear assembly and a shot is fired from the weapon the reconnaissance system is launched from the weapon and projected towards a target by the momentum of the bullet and/or the gases. When impacting upon the target the front assembly penetrates and sticks in the target whereupon the sensor assembly transmits data from the target area.

The sensor assembly may comprise any type of sensor for example one or more sensors chosen from the group comprising: electro-optical sensors; acoustic sensors; nuclear sensors; biological sensors; chemical sensors; and thermal sensors. In one embodiment, an acoustic sensor is used to trigger operation of the sensor assembly upon detection of an acoustic signal.

If the sensor assembly comprises an imaging device, then it can be positioned to directly acquire an image of a scene located exterior to the reconnaissance system or a reflective optical system can be provided to reflect the image of a scene located exterior to the reconnaissance system towards the imaging device. A motor may be connected to the imaging device or the optical system. The motor can do one or more of the following: rotate, tilt, move up or down, or move sidewards the imaging device or/or components of the optical system.

The sensor assembly may comprise a receiver capable of receiving operation commands to control operation of the sensor assembly. In a preferred embodiment of the weapon launched reconnaissance system of the invention the front assembly and/or the sensor assembly can be detached from the system and replaced with a different front assembly and/or sensor assembly having different components or parameters.

The front assembly may comprise explosive material capable of detonating upon impact with a target, thereby creating a hole in the target. The weapon launched reconnaissance system may comprise mechanical elements designed to absorb shocks and impacts that would affect the sensor assembly.

In one embodiment the weapon launched reconnaissance system comprises a wire or a mechanical interface connecting the front assembly and the sensor assembly. In this embodiment the center assembly can become disconnected from the front assembly upon impact, thereby leaving the front assembly with the sensor assembly connected to it stuck in the target.

The weapon launched reconnaissance system of the invention may comprise one or more of the following additional devices: a beacon; electronic warfare components; and communications jamming devices.

In another aspect the invention is a method of operating the weapon launched reconnaissance system. The method comprises the steps of:

a. supplying a weapon launched reconnaissance system according to the invention;
b. mounting the rear assembly of the weapon launched reconnaissance system on the barrel of the weapon and tightly fitting it;
c. aiming the weapon at the designated target and firing a single round of ammunition;
d. activating the sensor assembly when the front assembly of the weapon launched reconnaissance system impacts upon the target and penetrates it sticking to the target; and
e. receiving data sent by the sensor assembly of the weapon launched reconnaissance system to a receiver and data display unit.

DETAILED DESCRIPTION OF THE INVENTION

For a better understanding of the invention and to show how it may be carried into effect, reference will now be made, purely by way of example, to the accompanying drawings. With specific reference to the drawings in detail, it is stressed that the particulars shown are by way of example and for purposes of illustrative discussion of preferred embodiments of the present invention only and are presented for the purpose of providing what is believed to be the most useful and readily understood description of the principles and conceptual aspects of the invention. In this regard, no attempt is made to show structural details of the invention in more detail than is necessary for a fundamental understanding of the invention. From the description taken together with the drawings it will be apparent to those skilled in the art how the several forms of the invention may be embodied in practice.

The present invention provides a reconnaissance system in the form of an arrow that is designed to be attached to a barrel of a rifle. The arrow is launched from the rifle when a shot is fired by capturing the bullet released from the barrel of the rifle. The momentum imparted to the arrow by the bullet causes it fly a certain distance where it strikes and its head becomes embedded into a target. The reconnaissance system then transmits data from the target area to the remote operator.

Figure 1:
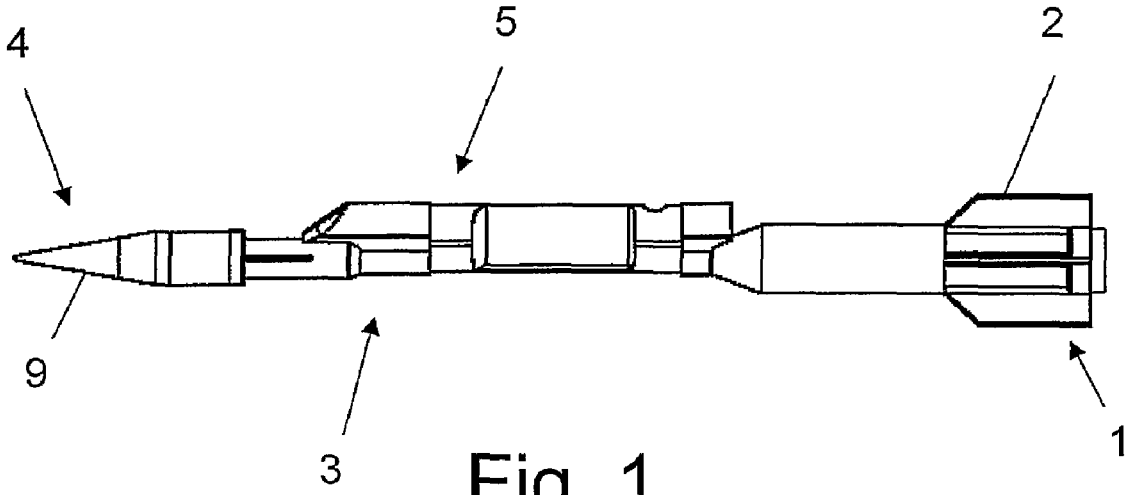
FIG. 1 schematically shows the general configuration of the reconnaissance system of the present invention.

FIG. 1 schematically shows the reconnaissance system of the present invention. The system comprises four main assemblies and is shown in this figure in its assembled state.

The rear assembly (1) is preferably configured as a tail having fins (2) on its exterior surface. The rear assembly is designed to be mounted on a barrel of a rifle and attached to it. The rear assembly is designed to match the diameter and other parameters of the rifle barrel on which it is to be mounted. The fins surrounding the tail are intended for aerodynamic purposes and stabilization of the system after it has been launched from the rifle.

A center assembly (3) is connected to the front edge to the rear assembly. The center assembly comprises within it a bullet-capture mechanism designed to capture a bullet, which is shot from the rifle. The bullet-capture mechanism captures the bullet absorbing the impact of the bullet with the device and thereby prevents damage to other components of the system. The momentum of the bullet is transferred to the system upon impact and is used to launch and carry the reconnaissance system to its target. The bullet-capture mechanism is designed to match the caliber of the bullet, which is shot from the rifle. The use of the bullet-capture mechanism enables "spontaneous" use of the system during combat, meaning there is no need to change from live rounds to blanks during combat. The system can be mounted on the rifle during combat, be fired from the rifle, and the combatant may continue to fire his weapon with no need to change magazines, i.e. use of the reconnaissance system of the invention allows deployment of the observation system with minimal disruption to the soldier's ability to participate in the battle.

It is also possible to design the system of the present invention to be used with bullet-less rounds (blank rounds) by making use of the gases released from the barrel for launching and projecting the reconnaissance system. In this case, the center assembly will be configured differently most notably without a bullet-capture mechanism. When a shot is fired high pressure gases are released through the barrel. These gases move directly into the reconnaissance system through the rear assembly (1) and into the center assembly (3). Gas and pressure release slots or other mechanisms may be implemented on the perimeter of the center assembly to stabilize the flight of the system along the desired trajectory.

A front assembly (4) is connected on to the front end of the center assembly. The front assembly comprises a nose portion (9) designed to penetrate and stick to a target upon impact. Those skilled in the art will appreciate that there are numerous possibilities, which vary depending on such factors as the target material, the distance to the target, etc., for implementing the nose portion.

A sensor assembly (5) is mounted on the center assembly (4). The sensor assembly may comprise one or more of a variety of sensors, including (but not limited to): electro-optical sensors, including still or video imaging devices, acoustic sensors, including audio sensors such as a microphone; nuclear sensors; biological sensors; chemical sensors; thermal sensors etc. The sensor assembly also comprises a transmitter designed to transmit the data acquired by the sensors to the remote operator and all electronics and power sources required for the operation of the sensor assembly. In a preferred embodiment of the present invention, a video sensor (imaging system) is implemented in the sensor assembly, thus when the system is launched and sticks in a remote target, it transmits live images of the target area; thereby providing the combatants with valuable real-time imagery data of the battle zone. In another embodiment the sensor assembly is located inside the center assembly, in a portion of the center assembly which does not absorb the direct impact of the bullet or the gases. In one embodiment the reconnaissance system comprises mechanical elements designed to absorb shocks and impacts around the sensor assembly.

Figure 2:
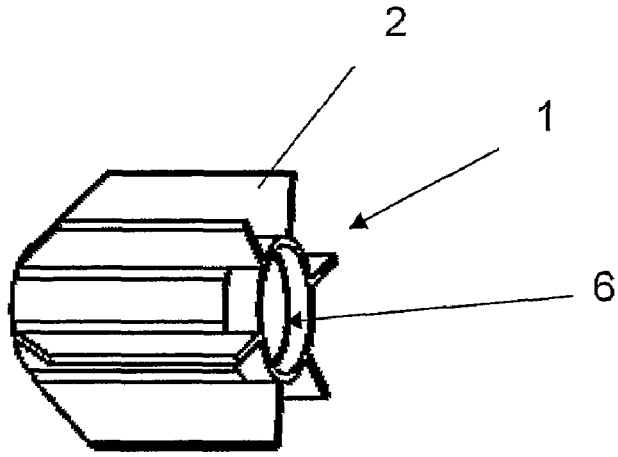
FIG. 2 schematically shows the rear assembly of the reconnaissance system of the present invention.

FIG. 2 schematically shows the rear assembly (1). The rear portion (6) of the rear assembly (1) is designed to tightly fit over and be mounted on the barrel of a rifle. The interior of the rear assembly (1) is hollow and designed to enable the bullet that is fired from the rifle and exits the barrel to travel through the rear assembly (1) and into the center assembly (not shown in FIG. 2). The rear assembly (1) is preferably designed according to NATO standards, which define an acceptable structure for accessories, such as grenade launchers, that are attached to the barrel of a rifle. Fins (2) are located on the exterior perimeter of the rear assembly (1) for purposes of aerodynamics and stabilization during flight.

Figure 3:
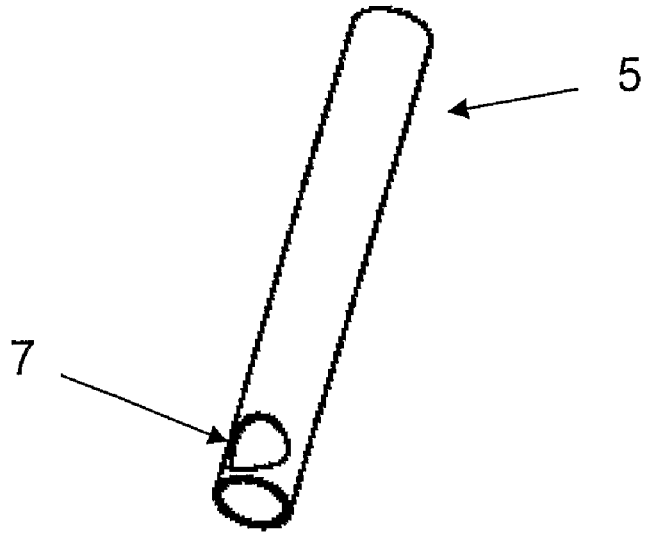
FIG. 3 schematically shows the sensor assembly of the reconnaissance system of the present invention.

FIG. 3 schematically shows the exterior of the sensor assembly (5). The sensor assembly comprises all components required for its operation, including the sensors, electronics, data transmitter, and power source. In a preferred embodiment of the present invention, at least one of the sensors in the sensor assembly is an imaging device capable of acquiring images of the area located around the sensor assembly, once the system arrived at the target. To enable realization of this embodiment, an opening (7) is formed in the wall of the sensor assembly to allow the imaging device to observe its surroundings and capture the images. The imaging system may either be placed to view the target area directly through the opening (7), or a reflective optical system may be implemented inside the sensor assembly, to reflect the image of the target area acquired through the opening (7) towards the imaging device which is located inside the sensor assembly. In another preferred embodiment of the present invention, the sensor assembly further comprises a scanning assembly comprising a motor, which can control movement of the imaging device and/or the optical system and allow it to control motion of the imaging system in an up or down or sidewards direction, to tilt the imaging system to allow for different angles of coverage and even to rotate the elements allowing scans of up to 360 degrees. The operation of the motor may be either automatic (pre-programmed, time delayed, continuous, event-triggered etc.) or can be operated by remote command sent from the operator. The acoustic sensor can be used to trigger operation of the sensor assembly upon detection of an acoustic signal. In cases where the sensor assembly is operable by remote commands of the operator, it is also required to include a receiver and appropriate electronics in the sensor assembly to receive and operate the sensor assembly accordingly. Commands which may be of relevance for remote operation may be: moving the imaging device, operating illumination, switching the sensor assembly in and out of standby mode to save energy etc. While theoretically communication between the surveillance system and the operator may be by means of an electrically conducting or fiber optic wire that trails behind the surveillance system as it travels from the rifle barrel to the target, the preferred means of communication is a wireless system.

It is possible to design different sensor assemblies that will be suitable for a different mission, environmental conditions, etc. Each of these assemblies may contain a partially or entirely different set of sensors or may have the same sensors which vary in their parameters e.g. a B/W camera versus a color camera or a wide aperture lens versus a narrow aperture lens. The sensor assembly is preferably designed so that its position and mechanical interface with the center assembly enables its easy replacement; thereby making it possible to replace the sensor assembly in the field and to use the sensor assembly which contains the most appropriate sensors for the desired task.

Figure 4:
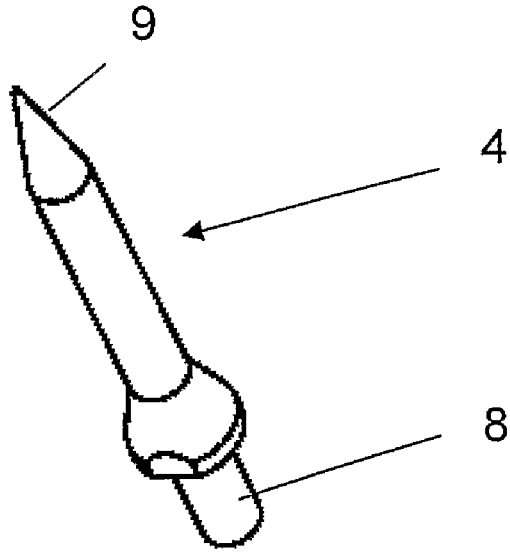
FIG. 4 schematically shows the front assembly of the reconnaissance system of the present invention.

FIG. 4 schematically shows the front assembly (4), which comprises the nose portion (9) of the reconnaissance system. In the embodiment shown, the front assembly is shaped as a sharp cone designed to enable penetration into solid targets upon impact. The rear portion (8) of the front assembly (4) is attached to the front end of center assembly (3, in FIG. 1) when the system is in its assembled state. It is preferable that the bullet capture mechanism described in reference to FIG. 1, be as close as possible to the front assembly in order to enable proper flight angle and effective penetration into the target. It is stressed that the nose portion must be designed having different sizes, cone angles, and materials depending on the parameters of the designated target, its distance from the rifle etc. It is also possible to include a certain amount of explosive material and a detonator in the front assembly, such that upon impact of the front assembly with the target, the detonator detonates the explosive material resulting in a hole or breach in the target and enabling the front assembly to penetrate and stick to the target.

In one embodiment of the present invention the front assembly may be disassembled from the system and can be replaced in the field with a different front assembly having different parameters that are more suitable to penetrate and stick to the designated target.

The reconnaissance system of the invention may further comprise additional devices such as: a beacon, preferably a laser beacon; different types of electronic warfare components; and communications jamming devices.

The reconnaissance system of the present invention is operated in the following manner:

the rear assembly (1) is mounted on the rifle's barrel and tightly fitted to it;

the operator aims the rifle at the designated target and fires a single round of live ammunition;

the bullet released from the rifle travels through the rear assembly (1) and through the center assembly (3) until it is captured by the bullet-capture mechanism located inside the center assembly;

the momentum of the bullet is transferred to the system, launching it from the rifle and propelling it towards the target;

the front assembly (4) hits the target and penetrates it sticking to the target;

the sensor assembly will be activated either automatically or by remote-control and will begin to send data to the operator; in the case one of the sensors is an image gathering system equipped with a scanning system, the image gather is positioned to acquire the field of view of interest.

According to one preferred embodiment of the present invention, upon impact with the target, the center assembly (3) and the rear assembly (1) will be detached from the remaining assemblies of the system. The front assembly (4) remains stuck in the target and the sensor assembly (5) is connected to the front assembly by a wire or a mechanical interface designed to position the sensor assembly relative to the front assembly at a specific angle, so that the imaging system located in the sensor assembly will be able to capture images of the scene of interest. For example, if the front assembly sticks into a wall of a building, right above a window, at a 90 degree angle, than the mechanical interface will position the sensor assembly orthogonal with the ground, thus enabling the imaging system to acquire images of inside the building though the window).

According to another preferred embodiment of the invention, upon impact with the target, the system will remain in its assembled configuration.

In order to obtain maximum benefit from the data acquired by the system of the present invention, the operator, who is a member of the unit in the field, is equipped with a receiver and data display unit, which is preferably configured to appropriately display all data types transmitted from the system. As described above, in some embodiments of the invention the display unit is also equipped with command buttons, electronics and transmitter to send operation commands from the operator to the system. In some embodiments, components are provided to relay the data received from the system from the local operator to other units in the field or to a centralized command post.

The description of the invention herein includes some preferred embodiments. It is obvious however that implementation of the system of the present invention depends on numerous factors which should be taken into account when the system is designed. Such factors include: the type of rifle used to launch the system, the type of ammunition used, the required flight distance, the type of the target, the type of data which is to be acquired, the required operating duration of the sensor assembly, the transmission distance of the data from the system to the operator, the necessity of remotely controlling the system's operation, the necessity of self-destruction of the system at a fixed time after launch or by remote command, etc. All of these factors and more may have to be taken into account and naturally will affect the design of the system. Because it is impractical to attempt to describe all possible configurations of the system, the description herein has been limited to the conceptual design of the system and should not limit the scope of the present invention.

In the description herein, the example of a "rifle" has been used to describe the means of launching the reconnaissance system and providing the propellant force necessary to carry it to the target. The use of the word "rifle" may be interpreted to imply that the common personal weapon of an infantry soldier equipped with live rounds is preferred. However, it is stressed, that other kinds of weapons may be used, e.g. rifles equipped with blanks, sniper rifles, shotguns, machine guns, and even pistols capable of launching "miniature" versions of the reconnaissance system. As previously mentioned, the designated type of weapon to be used with the system must be taken into account as a crucial factor when the system is designed.

The invention claimed is:

1. A weapon launched reconnaissance system comprising:

a. a rear assembly connectable to the barrel of a weapon, said rear assembly having a hollow passage enabling a bullet and/or exhaust gases coming out of said barrel to pass through it when said weapon is fired;

b. a center assembly, connected to the front end of said rear assembly, said center assembly comprising components for absorbing the momentum of said bullet and/or gases and transferring said momentum to said reconnaissance system;

c. a sensor assembly, including one or more sensors and data transmission components, said sensor assembly located within or on said center assembly; and d. a front assembly, connected to the front end of said center assembly, said front assembly comprising a nose portion capable of penetrating and sticking to solid materials upon impact;

wherein when said reconnaissance system is connected to the end of said barrel of said weapon by means of said rear assembly and a shot is fired from said weapon said reconnaissance system is launched from said weapon and projected towards a target by said momentum of said bullet and/or said gases and when impacting upon said target said front assembly penetrates and sticks in said target whereupon said sensor assembly transmits data from the target area.

2. A weapon launched reconnaissance system according to claim 1 wherein said rear assembly comprises fins on its exterior surface.

3. A weapon launched reconnaissance system according to claim 1 wherein the center assembly comprises slots or other mechanisms on its perimeter to release gas and pressure.

4. A weapon launched reconnaissance system according to claim 1, wherein the sensor assembly is located exterior to the center assembly.

5. A weapon launched reconnaissance system according to claim 1, wherein the sensor assembly is located inside the center assembly, in a portion of said center assembly which does not absorb the direct impact of the bullet or the gases.

6. A weapon launched reconnaissance system according to claim 1 wherein the sensor assembly comprises one or more sensors chosen from the group comprising:

a. electro-optical sensors;

b. acoustic sensors;

c. nuclear sensors;

d. biological sensors;

e. chemical sensors; and f. thermal sensors.

7. A weapon launched reconnaissance system according to claim 6, wherein the acoustic sensor triggers operation of the sensor assembly upon detection of an acoustic signal.

8. A weapon launched reconnaissance system according to claim 1, wherein the sensor assembly comprises an imaging device positioned to directly acquire an image of a scene located exterior to said reconnaissance system.

9. A weapon launched reconnaissance system according to claim 1, wherein the sensor assembly comprises an imaging device and a reflective optical system, said optical system reflecting the image of a scene located exterior to said reconnaissance system towards said imaging device.

10. A weapon launched reconnaissance system according to claim 8 or claim 9, wherein the sensor assembly further comprises a motor connected to the imaging device and/or elements of the optical system.

11. A weapon launched reconnaissance system according to claim 10, wherein the motor can do one or more of the following:

a. rotate the imaging device and/or components of the optical system;

b. tilt said imaging device and/or components of said optical system;

c. move said imaging device or components of said optical system up or down; and d. move said imaging device and/or components of said optical system in a sidewards direction.

12. A weapon launched reconnaissance system according to claim 1, wherein the sensor assembly comprises a receiver capable of receiving operation commands to control operation of said sensor assembly.

13. A weapon launched reconnaissance system according to claim 1, wherein the front assembly and/or sensor assembly can be detached from the system and replaced with a different front assembly and/or sensor assembly having different components or parameters.

14. A weapon launched reconnaissance system according to claim 1, wherein the front assembly comprises explosive material capable of detonating upon impact with a target, thereby creating a hole in said target.

15. A weapon launched reconnaissance system according to claim 1 comprising mechanical elements designed to absorb shocks and impacts that would affect the sensor assembly.

16. A weapon launched reconnaissance system according to claim 1, comprising a wire or a mechanical interface connecting the front assembly and the sensor assembly.

17. A weapon launched reconnaissance system according to claim 16, wherein the center assembly is disconnected from the front assembly upon impact, thereby leaving the front assembly with the sensor assembly connected to it stuck in the target.

18. A weapon launched reconnaissance system according to claim 1, comprising one or more additional devices selected from the following group:

a. a beacon;

b. electronic warfare components; and c. communications jamming devices.

19. A method of operating the weapon launched reconnaissance system, said method comprising:

a. supplying a weapon launched reconnaissance system according to claim 1;

b. mounting the rear assembly of said weapon launched reconnaissance system on the barrel of said weapon and tightly fitting it;

c. aiming said weapon at the designated target and firing a single round of ammunition;

d. activating the sensor assembly when the front assembly of said weapon launched reconnaissance system impacts upon the target and penetrates it sticking to said target; and e. receiving data sent by said sensor assembly of said weapon launched reconnaissance system to a receiver and data display unit.

* * * * *

UNITED STATES PATENT AND TRADEMARK OFFICE

CERTIFICATE OF CORRECTION

PATENT NO. : 7,437,985 B2
APPLICATION NO. : 11/791625
DATED : October 21, 2008
INVENTOR(S) : Ehud Gal It is certified that error appears in the above-identified patent and that said Letters Patent is hereby corrected as shown below:

Title page

Item [73], Amend assignee from
"O.D.F. Electronics Ltd." to --O.D.F. Optronics Ltd.--.

Signed and Sealed this

Sixth Day of January, 2009

JON W. DUDAS
*Director of the United States Patent and Trademark Office*